US006659184B1

(12) United States Patent
Tips et al.

(10) Patent No.: US 6,659,184 B1
(45) Date of Patent: Dec. 9, 2003

(54) MULTI-LINE BACK PRESSURE CONTROL SYSTEM

(75) Inventors: Timothy R. Tips, Spring, TX (US); Brett W. Bouldin, Spring, TX (US); Richard P. Rubbo, The Woodlands, TX (US)

(73) Assignee: Welldynamics, Inc., Spring, TX (US)

( * ) Notice: Subject to any disclaimer, the term of this patent is extended or adjusted under 35 U.S.C. 154(b) by 165 days.

(21) Appl. No.: 09/115,889

(22) Filed: Jul. 15, 1998

(51) Int. Cl.[7] ..... F21B 34/10
(52) U.S. Cl. ..... 166/375; 166/72; 166/320
(58) Field of Search ..... 166/320, 53, 374, 166/375, 319, 72, 363, 364

(56) References Cited

U.S. PATENT DOCUMENTS 4,407,183 A * 10/1983 Milberger et al. ..... 91/1
4,945,995 A * 8/1990 Tholance et al. ..... 166/375
6,247,536 B1 * 6/2001 Leismer et al. ..... 166/305.1
6,516,888 B1 * 2/2003 Gunnarson et al. ..... 166/373

* cited by examiner

*Primary Examiner*—David Bagnell
*Assistant Examiner*—Jennifer R. Dougherty
(74) *Attorney, Agent, or Firm*—J. Richard Konneker

(57) ABSTRACT

A multi-line back pressure control system for providing two way hydraulic line movement while maintaining back pressure control. Check valves are integrated in hydraulic fluid control lines extending downhole into a wellbore. Each check valve is pilot operated with pressure from another hydraulic line to selectively open the lines for two way fluid communication. Removal of the pilot pressure closes the check valves to provide passive back pressure control against catastrophic wellbore events. Pilot pressure operation between multiple pressurized lines can be provided with valves such as three-way, three-position piloted valves.

44 Claims, 3 Drawing Sheets

MULTI-LINE BACK PRESSURE CONTROL SYSTEM

BACKGROUND OF THE INVENTION

The present invention relates to a system for controlling downhole well tools to produce hydrocarbons from a wellbore. More particularly, the invention relates to a back pressure control system providing safe operation in multiple hydraulic control lines.

Downhole well tools control, select and regulate the production of hydrocarbon fluids and other fluids produced downhole from subterranean formations. Downhole well tools such as sliding sleeves, sliding side doors, interval control lines, safety valves, lubricator valves, chemical injection subs, and gas lift valves are representative examples of such tools. Well tools are typically controlled and powered from the wellbore surface by pressurizing hydraulic lines which extend from a Christmas Tree or other wellhead and into the wellbore lower end.

Dual pressure barriers in hydraulic lines are preferred to prevent hydraulic line failure during a wellbore catastrophic event. Dual pressure barrier systems have an active and a passive barrier. The active barrier typically comprises a valve located at the Christmas Tree or wellhead, and the passive barrier typically comprises a check valve located in the hydraulic line below the wellhead. The check valve restricts fluid flow in one direction as the hydraulic fluid, chemicals or other fluids are pumped downhole into the hydraulic line. The fluids pressurize an actuator in a single operation or are discharged into the tubing or wellbore annulus through an exit port or valve.

Certain tools such as safety valves require fluid flow control in opposite directions. However, safety valves do not internally provide dual barrier capabilities because such barriers would resist two-way fluid flow. Because safety valves do not provide a passive well control barrier, significant design effort has been made to enhance the reliability of safety valve operation. Safety valves have been designed with metal-to-metal fittings, metal dynamic seals, rod piston actuators, and other features designed to provide reliable operation during a catastrophic event in the wellbore. Other safety valves use springs, annulus fluid pressure, or tubing fluid pressure to provide the restoring force necessary to return the closure mechanism to the original position.

Downhole well tool actuators generally comprise short term or long term devices. Short term devices include one shot tools and tools having limited operating cycles. Hydraulically operated systems have mechanical mechanisms with simple shear pins or complex mechanisms performing over multiple cycles. Actuation signals are provided through mechanical, direct pressure, pressure pulsing, electromagnetic, and other mechanisms. The control mechanism may involve simple mechanics, fluid logic controls, timers, or electronics. Motive force can be provided through springs, differential pressure, hydrostatic pressure, or locally generated mechanisms. Long term devices provide virtually unlimited operating cycles and are designed for operation through the well producing life. One long term device provides a fail safe operating capabilities which closes with spring powered force when the hydraulic line pressure is lost. Combination electrical and hydraulic powered systems have been developed for downhole use.

Control for a downhole tool can be provided by connecting a single hydraulic line to a tool such as an internal control valve ("ICV") or a lubricator valve, and by discharging hydraulic fluid from the line end into the wellbore. This technique has several limitations as the hydraulic fluid exits the wellbore because of differential pressures between the hydraulic line and the wellbore. The discharge of hydraulic fluid into the wellbore comprises an undesirable environmental discharge, and the fluid discharge risks backflow and particulate contamination in the hydraulic system. Additionally, the setting depths are limited by the maximum pressure that a pressure relief valve can hold between the differential pressure between the control line pressure and the production tubing. All of these limitations effectively restrict single line hydraulic systems to relatively low differential pressure applications such as lubricator valves and sliding sleeves.

To overcome these limitations, a second hydraulic line can be installed to return hydraulic fluid to the wellbore surface through a closed loop. In U.S. Pat. No. 4,942,926 to Lessi (1990), dual hydraulic lines provided tool operation in two directions. In U.S. Pat. No. 3,906,726 to Jameson (1975), a manual control disable valve and a manual choke control valve controlled hydraulic fluid flow on either side of a piston head. In U.S. Pat. No. 4,197,879 to Young (1980) and in U.S. Pat. No. 4,368,871 to Young (1983), two hydraulic lines controlled a lubricator valve during well test operations. In all of these tools, two hydraulic lines are inefficient because the additional hydraulic lines increase sealing problems and reduce the available space through packers and wellheads. Additionally, passive barrier protection for each hydraulic line is not possible because of the return fluid flow from the well tool to the surface.

Accordingly, a need exists for an improved system capable of providing back pressure control in systems having multiple hydraulic lines. The system should be reliable, adaptable to different tool configurations and combinations, and should provide passive back flow containment for downhole well tools.

SUMMARY OF THE INVENTION

The present invention provides an apparatus for providing back pressure control in at least two hydraulic lines extending downhole in a wellbore. The apparatus comprises a check valve engaged with each of the hydraulic lines in a closed initial position, wherein each of said check valves prevents pressurized fluid downhole of the check valves from moving upstream of the check valves, and hydraulic means operable with the fluid pressure in a hydraulic line to selectively open a check valve engaged with another of the hydraulic lines to permit two-way fluid communication through the check valve. The hydraulic means is further operable when the hydraulic line fluid pressure is reduced to return the check valve to the initial position.

In other embodiments of the invention, each check valve can comprise a pilot operated check valve, and the invention is applicable to three or more hydraulic lines. The hydraulic means can comprise a control valve or control valve combination having fewer valves than hydraulic lines.

In another embodiment of the invention, the apparatus can selectively open fluid flow through hydraulic lines extending between a wellbore surface and a downhole tool. The apparatus can comprise a check valve engaged with each hydraulic line in a closed initial position where each of the check valves prevents pressurized fluid downhole of the check valve from moving upstream of said check valve, a hydraulic means operable with the fluid pressure in a hydraulic line to selectively open a check valve engaged with another hydraulic line to permit two-way fluid communication through the check valve, and a controller engaged with the hydraulic lines for selectively pressurizing at least one of the hydraulic lines to operate said hydraulic means and to open a check valve engaged with another of the hydraulic lines.

DESCRIPTION OF THE PREFERRED EMBODIMENTS

The present invention provides passive back pressure control in multiple hydraulic lines, and is adaptable to systems having two or more hydraulic lines. The invention facilitates the creation of hydraulic line systems providing control functions and power requirements for the actuation of downhole well tools.

Figure 1:
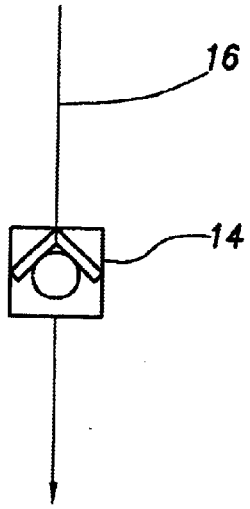
FIG. 1 illustrates engagement of a check valve in a hydraulic line.
Figure 2:
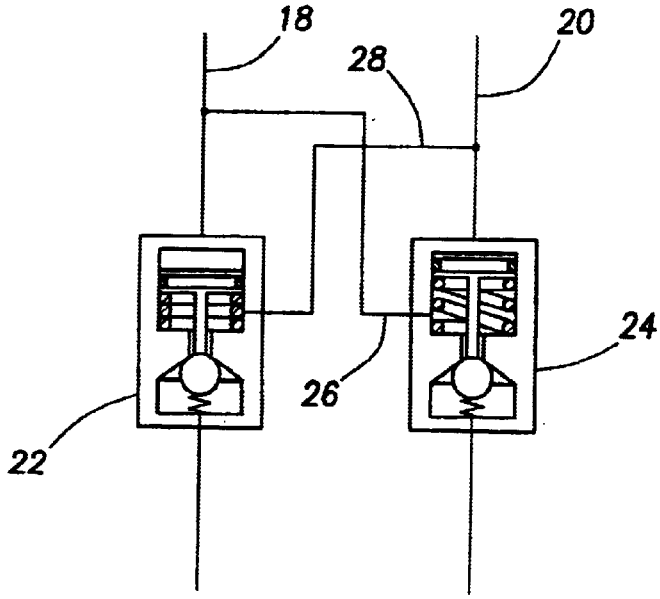
FIG. 2 illustrates two hydraulic lines engaged having a pilot opening feature.

FIG. 1 illustrates the placement of conventional back check valve 14 in hydraulic fluid line 16. Hydraulic line 16 can extend from the wellbore surface to engagement located downhole in the wellbore. As illustrated, the direction of fluid flow can move in one direction and is prevented from flowing in the opposite direction. FIG. 2 illustrates the application of the invention to two hydraulic fluid lines 18 and 20, wherein pilot operated check valves 22 and 24 are integrated in fluid lines 18 and 20. Check valves 22 and 24 operate as conventional check valves to prevent fluid flow upwards from the lower end of fluid lines 18 and 20. However, pilot operated check valves 22 and 24 perform a different function when combined with another fluid pressure source. When fluid line 18 is pressurized, fluid moves downwardly through check valve 22 and is further directed through line 26 to check valve 24 to open check valve 24 to two-way fluid flow. Similarly, the separate operation of fluid line 20 moves fluid downwardly through check valve 24 and is further directed through line 28 to open check valve 22 to provide two-way fluid flow. When the fluid pressure within line 18 is removed, the pilot function for valve 24 is removed and valve 24 closes to provide a passive pressure barrier. When the fluid pressure within line 20 is removed, the pilot function for valve 22 is removed and valve 22 closes to provide a passive pressure barrier.

Figure 3:
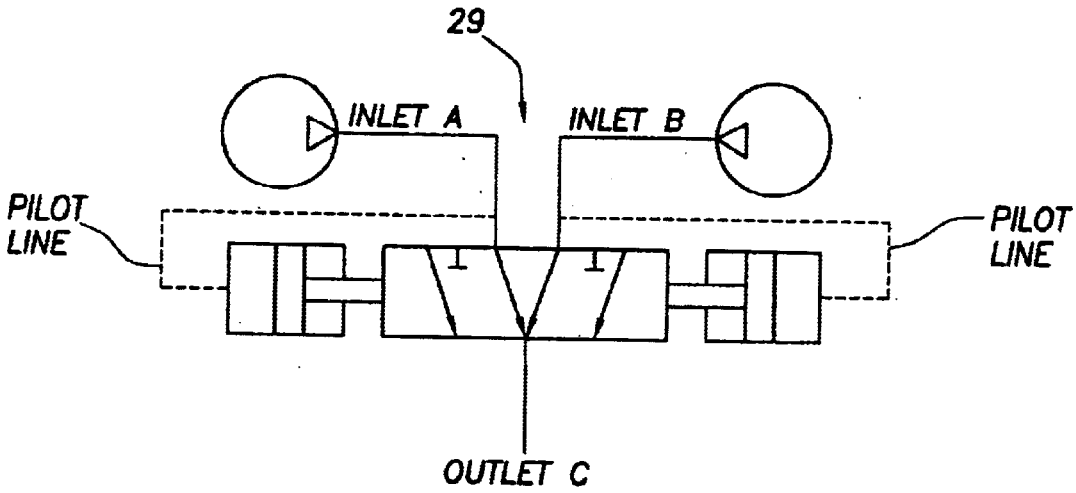
FIG. 3 shows a three-way three-position valve.

The extension of the invention to more than two hydraulic lines is accomplished by incorporating a valve for providing control over the pressure communication or flow of fluid from multiple lines. One such valve is illustrated in FIG. 3, wherein three-way, three-position piloted valve 29 has two positions and three ports. Two ports comprise inlet ports and the third comprises an outlet port. An internal, free floating check ball senses flow and pressure from the two inlet ports and closes the lessor flow inlet port in favor of the greater flow inlet port. In this manner, shuttle valve 29 automatically provides a switching function between multiple lines without requiring electrically operated solenoid valves, additional hydraulic lines, electronic controls, or other combinations conventionally used. Different combinations of pilot activated check valves and hydraulic switching valves such as shuttle valve 29 can be connected in series or in parallel in various configurations and combinations to accomplish different operating functions. This combination provides unique flexibility in providing back pressure control in complex hydraulic operating systems.

Figure 4:
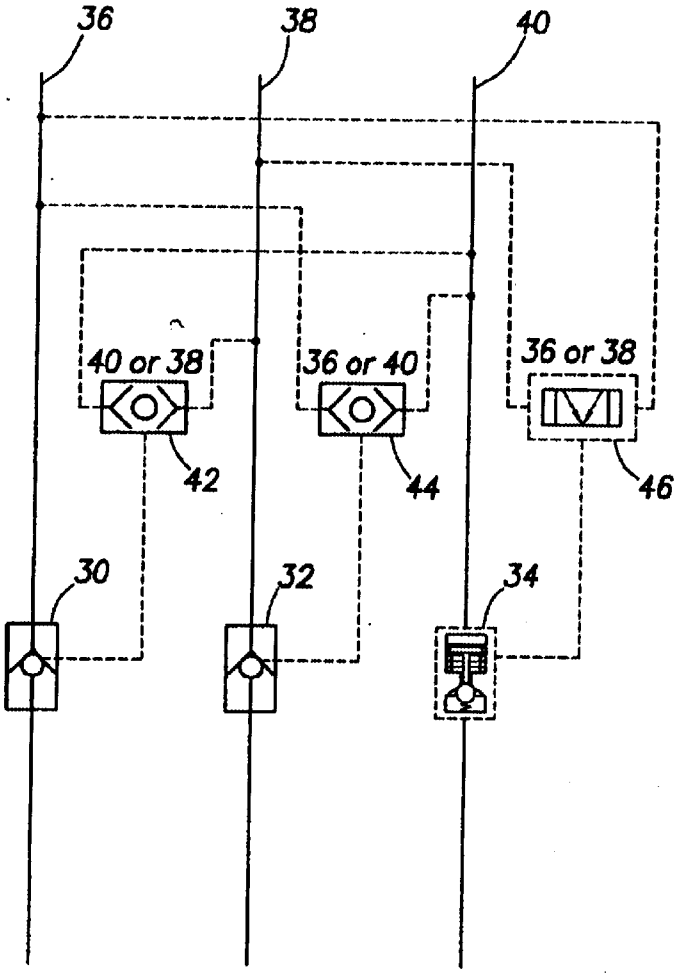
FIG. 4 illustrates a three hydraulic line application of the invention, wherein a valve is associate with each check valve.

FIG. 4 illustrates a three hydraulic line system wherein pilot check valves 30, 32 and 34 are integrated with hydraulic lines 36, 38 and 40 to provide passive back pressure control. Non-selective valves 42, 44 and 46 are integrated into the system to selectively provide the pilot function for check valves 30, 32 and 34. Pressurization of line 36 opens check valve 30 and further operates valve 44 to open check valve 32, and operates valve 46 to open check valve 34. Release of the pressure for line 36 causes check valves 30, 32 and 34 to close lines 36, 38 and 40. Similarly, pressurization of line 38 opens check valve 32, operates valve 42 to open check valve 30, and further operates valve 46 to open check valve 34. Release of the pressure for line 38 causes check valves 30, 32 and 34 to close lines 36, 38 and 40. Pressurization of line 40 accomplishes a similar function of opening lines 36, 38 and 40. The dual pressurization of two lines such as lines 36 and 38 opens check valves 30 and 32 and operates valve 46 to open check valve 34 because pressure from line 36 or line 38 will move through valve 46 to open check valve 34.

Figure 5:
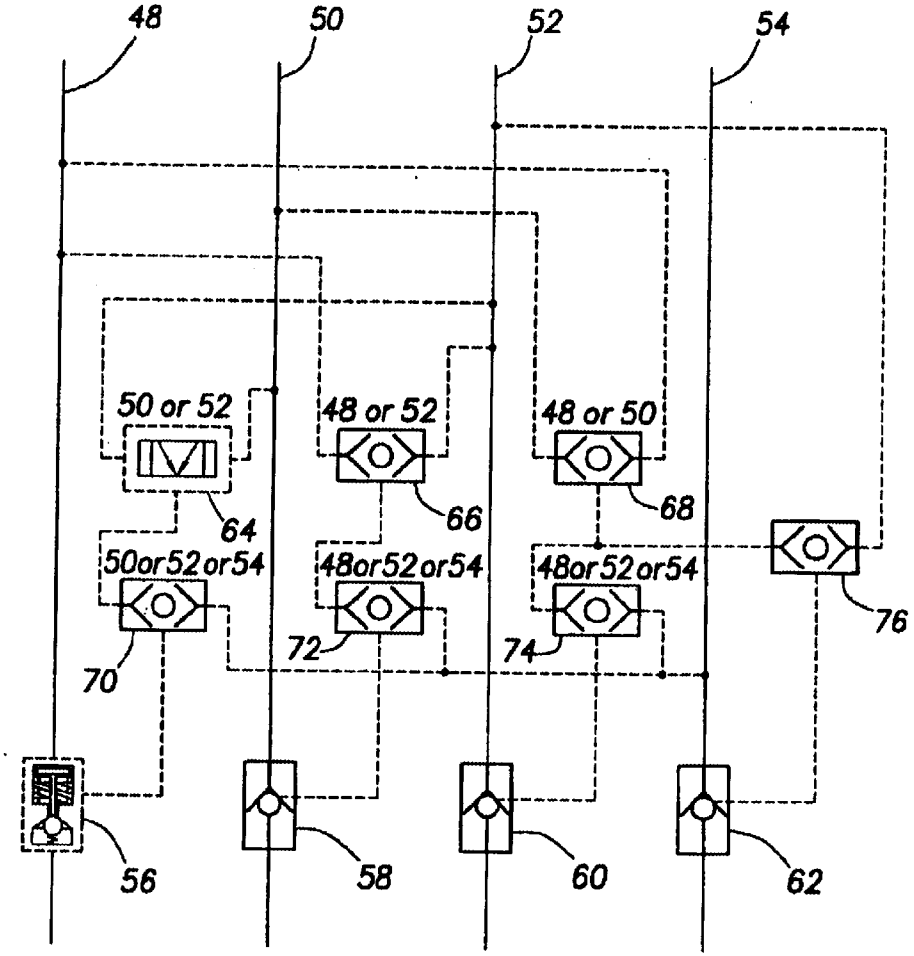
FIG. 5 illustrates a four hydraulic line application of the invention.

FIG. 5 illustrates another embodiment of the invention applied to a four line system having lines 48, 50, 52 and 54, check valves 56, 58, 60 and 62, and valves 64, 66, 68, 70, 72, 74 and 76. Pressurization of line 48 opens check valve 56, operates valve 66 to operate valve 72 to open check valve 58, operates valve 68 to operate valve 74 to open check valve 60 and to operate valve 76 to open check valve 62. In this fashion, the pressurization of line 48 opens all four check valves 56, 58, 60 and 62. Similarly, the pressurization of line 52 opens check valve 60, operates valve 64 to operate valve 70 to open check valve 56, operates valve 66 to operate valve 72 to open check valve 58, and operates valve 76 to open check valve 62. Withdrawal of pressure in line 52 causes each check valve to return to the initial closed position.

Figure 6:
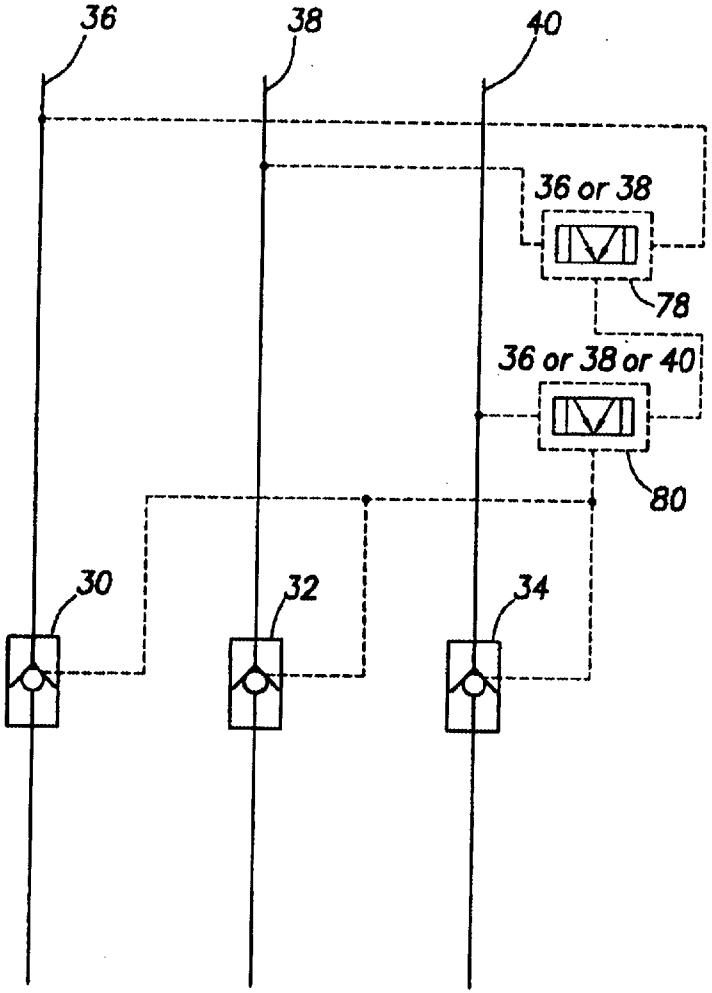
FIG. 6 illustrates another application of the invention to a three hydraulic line system.

FIG. 6 illustrates another combination of components for a three line isolation system to selectively open and close lines 36, 38 and 40 with check valves 30, 32 and 34. Valves 78 and 80 provide the functional operation provided by the three valves identified in FIG. 4. Valves 78 and 80 provide a package for simultaneously opening check valves 30, 32 and 34. When line 36 or line 38 is pressurized, such hydraulic fluid line pressure operates valve 78 to operate valve 80 to open the check valves. When line 40 is pressurized, valve 80 is operated to open the check valves.

Figure 7:
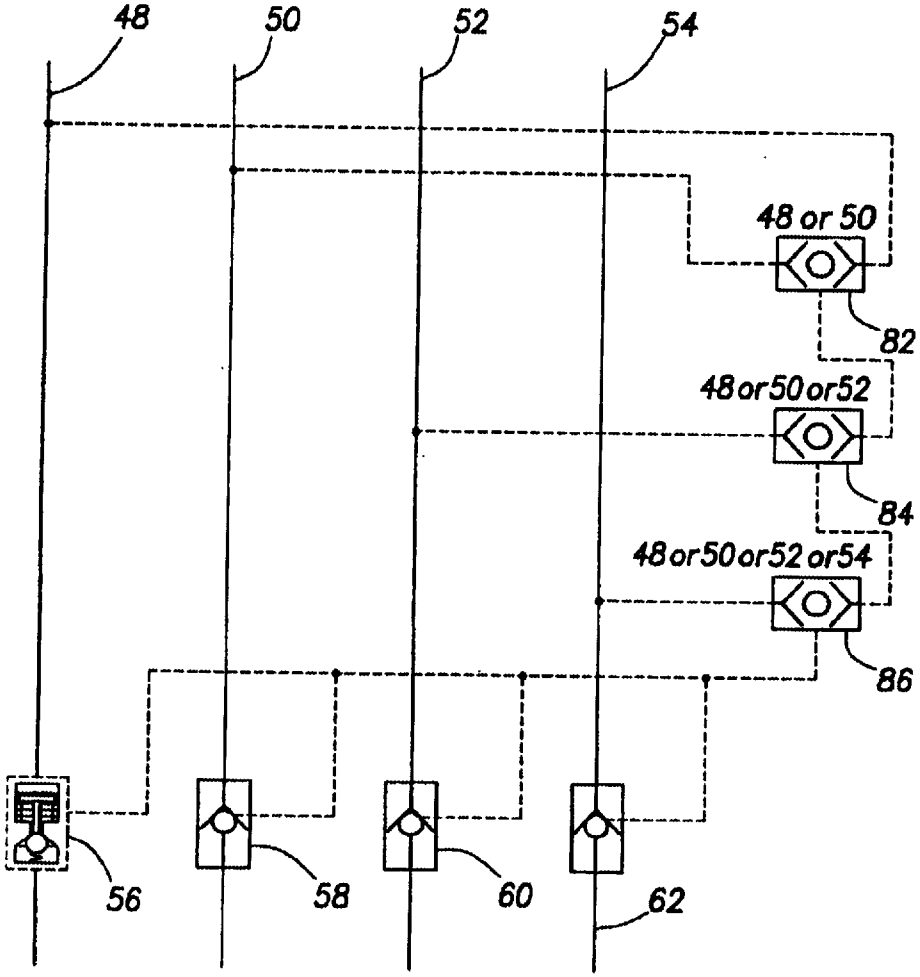
FIG. 7 illustrates another application of the invention to a four hydraulic line system.

FIG. 7 illustrates another embodiment of a four line isolation system to selectively open and close lines 48, 50, 52 and 54 with check valves 56, 58, 60 and 62. Valves 82, 84, and 86 provide the functional operation provided by the seven similar valves shown in FIG. 5. When line 48 or line 50 is pressurized, such line pressure operates valve 82 to operate valve 84 and to operate valve 86 to open check valves 56, 58, 60 and 62. When line 52 is pressurized, valve 84 operates valve 86 to open the check valves. When line 54 is pressurized, valve 86 is operated to open the check valves.

The invention is particularly suited to systems requiring hydraulic fluid reliability to the control of downhole well tools by uniquely utilizing hydraulics with logic circuitry. Such logic circuitry is analogous to electrical and electronics systems, and can incorporate Boolean Logic using "AND" and "OR" gate combinations.

The invention is particularly suitable for use with digital-hydraulic control systems serving multiple well control devices. In such system, pressure is applied in a coded sequence to several hydraulic lines. The coded sequence automatically selects one of the well control devices and provides independent operation of the well control device. Instead of discharging hydraulic fluid into the tubing or wellbore, excess fluid is returned up one of the unpressurized hydraulic lines. To permit return flow of the excess fluid, a system must permit such return flow through one or more hydraulic lines, and this return flow is provided by controlling the opening of the pilot operated check valves.

The invention provides passive back check valves on each hydraulic line. If one or more of the lines are pressurized from the wellbore surface, the back check valves in the unpressurized lines are temporarily opened with pilot pistons activated by the pressurized lines. In this configuration, the passive barriers provided by the back check valves are temporarily opened for two-way fluid communication to permit single tool operation or to permit selected tool operation for different combinations. After the pressure in a hydraulic line is removed and the line pressure is bled down or otherwise reduced, the back check valve on such hydraulic line closes to prevent fluid flow in such direction. Passive back pressure control is maintained because pressure from below does not open the back check valve, and the piloting pressure to open the back check valves is only provided by hydraulic line pressure above the valve.

Although the invention has been described in terms of certain preferred embodiments, it will become apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. An apparatus for providing back pressure control in at least two hydraulic lines extending downhole in a wellbore, comprising:

a check valve engaged with each of the hydraulic lines in a closed initial position, wherein each of said check valves prevents pressurized fluid downhole of said check valves from moving upstream of said check valves; and hydraulic means operable with the fluid pressure in a hydraulic line to selectively open a check valve engaged with another of the hydraulic lines to permit two-way fluid communication through said check valve, wherein said hydraulic means is further operable when said hydraulic line fluid pressure is reduced to return said check valve to said initial position.

2. An apparatus as recited in claim 1, wherein each check valve comprises a pilot operated check valve.

3. An apparatus as recited in claim 1, wherein said hydraulic means comprises a pilot mechanism for each of said check valves.

4. An apparatus as recited in claim 1, wherein increased fluid pressure in a hydraulic line further opens the check valve engaged with such hydraulic line to permit two-way communication through said check valve.

5. An apparatus as recited in claim 1, further comprising at least three check valves each engaged with a separate hydraulic line, and wherein said hydraulic means comprises a control valve engaged with two of said hydraulic lines for selectively communicating fluid pressure in one of two hydraulic lines to open the check valve engaged with said third hydraulic line.

6. An apparatus as recited in claim 5, wherein said hydraulic means comprises a first control valve engaged with the first and second hydraulic lines and with a second control valve engaged with the third hydraulic line, and wherein said second control valve is operable in response to fluid pressure in the third hydraulic line to open all three check valves, and wherein said second control valve is further operable in response to said first control valve to open all three check valves.

7. An apparatus as recited in claim 1, wherein said hydraulic means comprises two or more three-way three-position valves each operable in response to fluid pressure from one of two hydraulic lines to engage and open one of said check valves for permitting two-way fluid communication through said check valve.

8. An apparatus as recited in claim 7, wherein each three-way three-position valve is operable to open all of said check valves for permitting two-way fluid communication through said check valves.

9. An apparatus as recited in claim 1, wherein said hydraulic means comprises at least three control valves each engaged with at least one hydraulic line and with at least one of said other control valves, wherein each control valve is operable in response to fluid pressure from one of said hydraulic lines or other control valves to open at least one of said check valves.

10. An apparatus as recited in claim 9, wherein one of said control valves comprises a master control valve engaged with each hydraulic line and with each of said check valves so that hydraulic fluid pressure in one of the hydraulic lines is transmitted through said master control valve to open all of said check valves for two-way fluid communication.

11. An apparatus for selectively opening fluid flow through hydraulic lines extending between a wellbore surface and a downhole tool, comprising:

a check valve engaged with each hydraulic line in a closed initial position, wherein each of said check valves prevents pressurized fluid downhole of said check valve from moving upstream of said check valve;

hydraulic means operable with the fluid pressure in a hydraulic line to selectively open a check valve engaged with another hydraulic line to permit two-way fluid communication through said check valve; and a controller engaged with the hydraulic lines for selectively pressurizing at least one of the hydraulic lines to operate said hydraulic means to open a check valve engaged with another of the hydraulic lines.

12. An apparatus as recited in claim 11, wherein each check valve comprises a back flow device having an override.

13. An apparatus as recited in claim 11, wherein said hydraulic means comprises an override engaged with each of said check valves.

14. An apparatus as recited in claim 11, wherein said hydraulic means is configured to open each check valve by the operation of said controller to pressurize a selected hydraulic line.

15. An apparatus as recited in claim 11, wherein said hydraulic means is configured to open a selected combination of check valves by the operation of said controller to pressurize a selected hydraulic line.

16. An apparatus as recited in claim 11, wherein said hydraulic means is configured to open each check valve by the pressurization of one hydraulic line.

17. An apparatus as recited in claim 16, wherein said hydraulic means is configured so that the pressurization of each hydraulic line independently opens all of said check valves to two-way fluid communication.

18. An apparatus as recited in claim 11, wherein said controller is operable to withdraw pressurization of said hydraulic lines to return each of said check valves to said closed initial position.

19. Apparatus for supplying hydraulic power to a downhole well tool, comprising:

two hydraulic lines; and first and second valves each installed in one of the lines and connected to the other line to receive fluid pressure therefrom, each valve being operative to (1) permit fluid flow in only one direction through the line in which it is installed absent receipt of fluid pressure from the other line, and (2) permit fluid flow in opposite directions through the line in which it is installed in response to receipt of fluid pressure from the other line.

20. The apparatus of claim 19 wherein:

each of the first and second valves is a check valve.

21. The apparatus of claim 20 wherein:

each of the first and second check valves is a pilot-operated check valve having a pilot inlet coupled to the line in which the other valve is installed.

22. The apparatus of claim 21 wherein:

each of the pilot-operated check valves has an uphole side, and the pilot inlet of each pilot-operated check valve is coupled to an uphole portion of the line in which the other pilot-operated check valve is installed.

23. A method of supplying hydraulic power to a downhole well tool, the method comprising the steps of:

providing two hydraulic lines;

installing a valve in each hydraulic line, each valve being normally operative to permit fluid flow in only one direction through the hydraulic line in which it is installed; and causing one of the valves to permit fluid flow in opposite directions through the hydraulic line in which it is installed in response to pressure within the other hydraulic line.

24. The method of claim 23 wherein:

each valve is a pilot-operated check valve having a pilot inlet, and the installing step includes the step of coupling the pilot inlet of each pilot-operated check valve to the hydraulic line in which the other pilot-operated check valve is installed.

25. The method of claim 24 wherein:

each pilot-operated check valve has an uphole side, and the coupling step is performed by coupling the pilot inlet of each pilot-operated check valve to an uphole portion of the line in which the other pilot-operated check valve is installed.

26. Apparatus for supplying hydraulic power downhole in a subterranean well, comprising:

at least three hydraulic lines each having a valve installed therein, the valve having a normal position in which it permits fluid flow in only one direction through the hydraulic line and being pressure shiftable from its normal position to an open position in which the valve permits fluid flow in opposite directions through the hydraulic line; and control apparatus interconnecting each valve with the hydraulic lines of at least two other valves and being operative to transmit pressure from a selected one of the other valve hydraulic lines to the first-mentioned valve to shift it from its normal position to its open position.

27. The apparatus of claim 26 wherein:

there are at least four hydraulic lines each having a valve installed therein.

28. The apparatus of claim 26 wherein:

each valve is a check valve.

29. The apparatus of claim 26 wherein:

each valve is a pilot-operated check valve.

30. The apparatus of claim 29 wherein:

each pilot-operated check valve has a pilot inlet, and the control apparatus includes a plurality of fluid switching valves interconnected between the pilot inlets and the hydraulic lines.

31. The apparatus of claim 30 wherein:

each fluid switching valve has an outlet coupled to one of the pilot inlets, and a pair of inlets coupling the fluid switching valves to at least two of the hydraulic lines.

32. The apparatus of claim 30 wherein:

each fluid switching valve is a movable shuttle-type fluid switching valve.

33. The apparatus of claim 30 wherein:

the plurality of fluid switching valves are operative, in response to the pressurization of any one of the hydraulic lines, to shift all of the valves installed in the other hydraulic lines from their normal positions to their open positions.

34. The apparatus of claim 30 wherein:

each pilot-operated check valve has an uphole side, and the plurality of fluid switching valves are interconnected between the pilot inlets and uphole portions of the hydraulic lines.

35. The apparatus of claim 26 wherein:

the control apparatus is further operative, in response to the pressurization of any one of the hydraulic lines, to shift all of the valves installed in the other hydraulic lines from their normal positions to their open positions.

36. A method of supplying hydraulic power downhole in a subterranean well, the method comprising the steps of:

providing at least three hydraulic lines each having a valve installed therein that has a normal position in which it permits fluid flow in only one direction through the hydraulic line and is pressure shiftable from its normal position to an open position in which the valve permits fluid flow in opposite directions through the hydraulic line; interconnecting control apparatus between each valve and the hydraulic lines of at least two other valves; and utilizing the control apparatus to transmit pressure to a selected valve from a selected one of the other valve lines to shift the selected valve from its normal position to its open position.

37. The method of claim 36 wherein:

the providing step is performed by providing at least four hydraulic lines each having a valve installed therein.

38. The method of claim 36 wherein:

each valve is a pilot-operated check valve having a pilot inlet, and the interconnecting step is performed by coupling the pilot inlet of each valve to the hydraulic lines of at least two other valves.

39. The method of claim 36 further comprising the step of:

causing the control apparatus, in response to pressurization of the hydraulic line of a selected valve, to shift all of the other valves from their normal positions to their open positions.

40. The method of claim 36 wherein:

each valve has an uphole side and a downhole side, and the interconnecting step is performed by interconnecting the control apparatus between each valve and uphole portions of the hydraulic lines of at least two other valves.

41. Apparatus for supplying hydraulic power downhole in a subterranean well, comprising:

a plurality of hydraulic lines extendable downhole through the well, each line having uphole and downhole portions;

a plurality of valves each respectively installed in a different one of the hydraulic lines between its uphole and downhole portions, each valve having a normal position in which it permits fluid flow only in a downhole direction through the hydraulic line in which it installed, and an open position in which it permits fluid flow in both uphole and downhole directions through the hydraulic line in which it is installed; and control apparatus operative in response to pressurization of the uphole portion of a selected hydraulic line to shift at least one valve in another hydraulic line from its normal position to its open position.

42. The apparatus of claim 41 wherein:

the control apparatus is operative in response to pressurization of the uphole portion of a selected hydraulic line to shift each valve in each other hydraulic line from its normal position to its open position.

43. A method of supplying hydraulic power downhole in a subterranean-well, the method comprising the steps of:

providing a plurality of hydraulic lines extendable downhole through the well, each hydraulic line having an uphole portion and a downhole portion;

respectively installing each of a plurality of valves in a different one of the plurality of hydraulic lines between its uphole and downhole portions, each valve having a normal position in which it permits fluid flow only in a downhole direction through the hydraulic line in which it installed, and an open position in which it permits fluid flow in both uphole and downhole directions through the hydraulic line in which it is installed; and operatively associating control apparatus with the valves and the hydraulic lines, the control apparatus being operative in response to pressurization of the uphole portion of a selected hydraulic line-to shift at least one valve in another hydraulic line from its normal position to its open position.

44. The method of claim 43 wherein:

the operatively associating step is performed utilizing control apparatus operative in response to pressurization of the uphole portion of a selected hydraulic line to shift each valve in each other hydraulic line from its normal position to its open position.

* * * * *